US011437757B2

(12) United States Patent
Imamura et al.

(10) Patent No.: US 11,437,757 B2
(45) Date of Patent: Sep. 6, 2022

(54) CONNECTOR UNIT

(71) Applicant: Yazaki Corporation, Tokyo (JP)

(72) Inventors: Masaki Imamura, Makinohara (JP); Akihiro Tsuruta, Fujieda (JP); Koutaro Tobino, Fujieda (JP); Kazuhide Ikeya, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/201,131

(22) Filed: Mar. 15, 2021

(65) Prior Publication Data

US 2021/0320457 A1 Oct. 14, 2021

(30) Foreign Application Priority Data

Apr. 13, 2020 (JP) ..... JP2020-071632

(51) Int. Cl.
*H01R 13/62* (2006.01)
*H01R 13/629* (2006.01)
*H01R 13/641* (2006.01)

(52) U.S. Cl.
CPC . *H01R 13/62938* (2013.01); *H01R 13/62955* (2013.01); *H01R 13/641* (2013.01)

(58) Field of Classification Search
None
See application file for complete search history.

(56) References Cited

U.S. PATENT DOCUMENTS 6,319,050 B1 * 11/2001 Miyazaki ..... H01R 13/62938 439/157
10,910,765 B2 * 2/2021 Ochiai ..... H01R 13/62977

FOREIGN PATENT DOCUMENTS

JP 2004-319126 A 11/2004
JP 2010-146950 A 7/2010
JP 2011-23128 A 2/2011

* cited by examiner

*Primary Examiner* — Ross N Gushi
(74) *Attorney, Agent, or Firm* — Sughrue Mion, PLLC

(57) ABSTRACT

A connector unit includes a first housing and a second housing which are mateable, and a lever element to be pivotably supported by the first housing, wherein the lever element includes a plate-shaped lever main body and a sliding element, wherein the lever main body is rotatable between an initial position and a completely rotated position for both housings, wherein the second housing includes a locking portion, wherein the lever main body includes a locked portion which is locked by the locking portion in the completely rotated position, wherein the sliding element is provided so as to be slidable between a protruding position and a pushed-in position, and wherein the sliding element is configured so that in the protruding position, the lever main body is rotated and the locking portion locks the locked portion in order to slide the sliding element from the protruding position to the pushed-in position.

4 Claims, 9 Drawing Sheets

CONNECTOR UNIT

BACKGROUND OF THE INVENTION

Technical Field

The present invention relates to a connector unit.

Background Art

Conventionally, a lever-based connector has been proposed which is configured with a female connector, a male connector, a lever for mating the female connector with the male connector, and a detecting element attached to the lever (see e.g. Patent Document 1).

The lever-based connector according to Patent Document 1 is configured so that the lever is rotated in order to bring the female connector and the male connector close to each other and to mate them while the lever is pivotably supported on the female connector. The detecting element is supported by the lever so as to be slidable between a waiting position and a detecting position, wherein the waiting position is farthest from a pivotably supporting position of the lever and the detecting position is closest to the pivotably supporting position. The detecting element is configured to slide from the waiting position to the detecting position when the female connector is mated with the male connector, wherein when the female connector is not mated with the male connector, the detecting element does not slide from the waiting position to the detecting position to enable an operator to detect a non-mated state of these connectors.

CITATION LIST

Patent Literature

Patent Document 1: JP 2010-146950 A

SUMMARY OF THE INVENTION

However, for assembling such a conventional lever-based connector, the lever is rotated to mate the female connector with the male connector, and thereafter, the detecting element is slid from the waiting position to the detecting position. This means that two operations need to be performed by the operator, i.e. rotation of the lever and sliding the detecting element, which results in a bad operability for assembling.

An objective of the present invention is to provide a connector unit which can enable the operability for assembling to be improved.

In order to achieve this objective, the invention according to claim 1 relates to a connector unit which includes a first housing and a second housing which are mateable with each other, and a lever element to be pivotably supported by the first housing, wherein the lever element includes a plate-shaped lever main body to be pivotably supported by the first housing, and a sliding element which is provided at the lever main body in a slidable manner, wherein the lever main body is provided so as to be rotatable between an initial position and a completely rotated position, wherein in the completely rotated position, the first housing and the second housing are in a mated state, wherein the second housing is provided with a locking portion for locking the lever main body, wherein the lever main body is provided with a locked portion which is configured to be locked by the locking portion in the completely rotated position, wherein the sliding element is provided so as to be slidable between a protruding position and a pushed-in position, wherein the sliding element protrudes from the lever main body in the protruding position, and is pushed deeper into the lever main body in the pushed-in position than in the protruding position, and wherein the sliding element is configured so that in the protruding position, the lever main body is rotated and the locking portion locks the locked portion in order to slide the sliding element from the protruding position to the pushed-in position.

The invention according to claim 2 provides that in the invention according to claim 1, the second housing includes a hood portion for accommodating the first housing, wherein the sliding element has a pushing surface which is oriented in a direction opposite to a push-in direction of the sliding element into the lever main body, wherein the pushing surface is positioned in a same plane as an opening edge of the hood portion when the sliding element is positioned in the pushed-in position.

The invention according to claim 3 provides that in the invention according to claim 1 or 2, when the sliding element is positioned in the protruding position, a pushing surface of the sliding element which is oriented in a direction opposite to a push-in direction of the sliding element into the lever main body protrudes from an end edge of the lever main body, wherein when the sliding element is positioned in the protruding position, a first distance of a pivotably supporting position of the lever main body to the pushing surface is larger than a second distance of the pivotably supporting position to the end edge of the lever main body.

The invention according to claim 1 is provided so that the lever main body is rotated by pushing the sliding element in order to bring the first housing and the second housing into the mated state, wherein the sliding element is further allowed to be moved from the protruding position to the pushed-in position in order to enable the operator to detect (recognize) that the first housing and the second housing are in the mated state. With the one single operation (action) as described above, i.e. pushing the sliding element, the first housing and the second housing can be mated with the each other, wherein at the same time, the operator can detect (recognize) that the first housing and the second housing are in the mated state, which may enable the operability for assembling the connector unit to be improved.

DETAILED DESCRIPTION OF THE PREFERRED EMBODIMENTS

Figure 1:
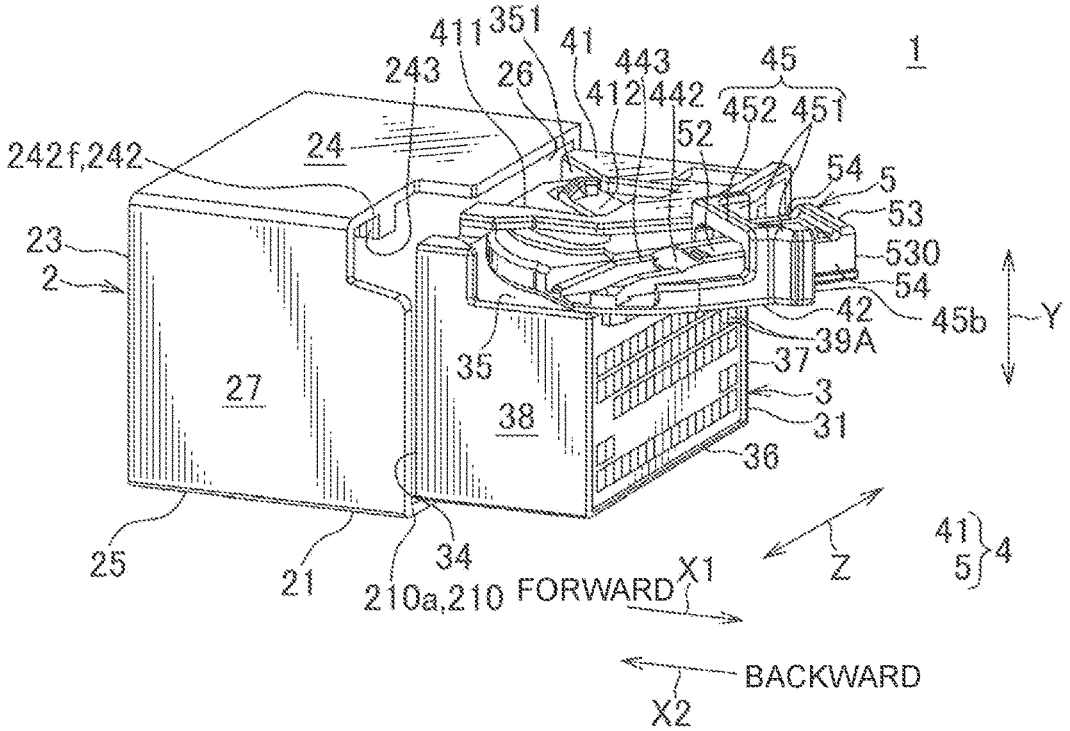
FIG. 1 is a perspective view illustrating a state of a connector unit according to an embodiment of the present invention before mating the male connector and the female connector with each other.
Figure 2:
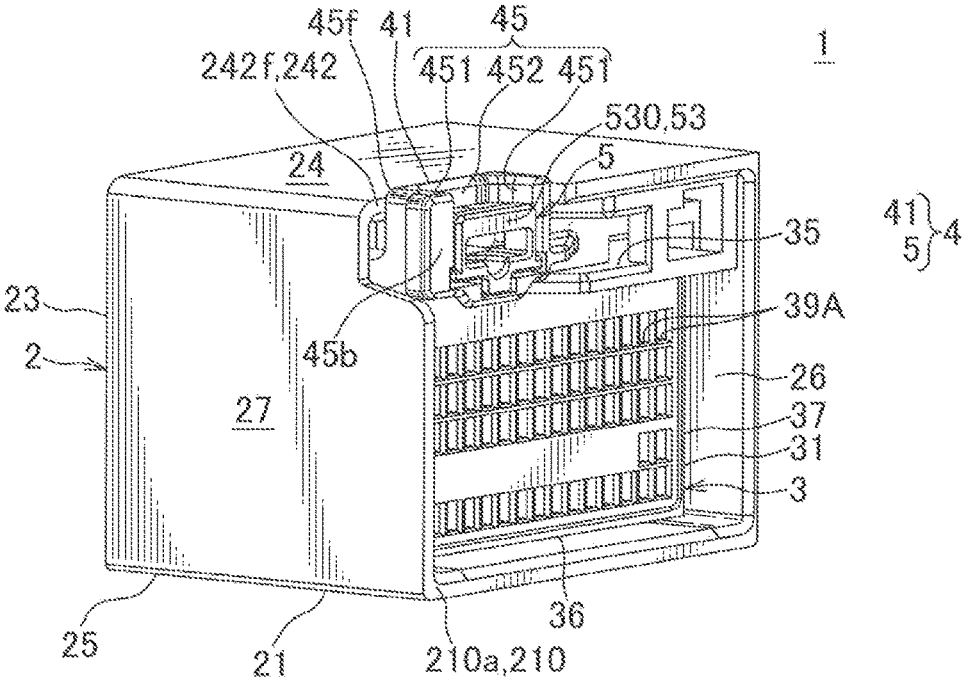
FIG. 2 is a perspective view illustrating a state of the connector unit in which the male connector and the female connector are mated with each other.
Figure 3:
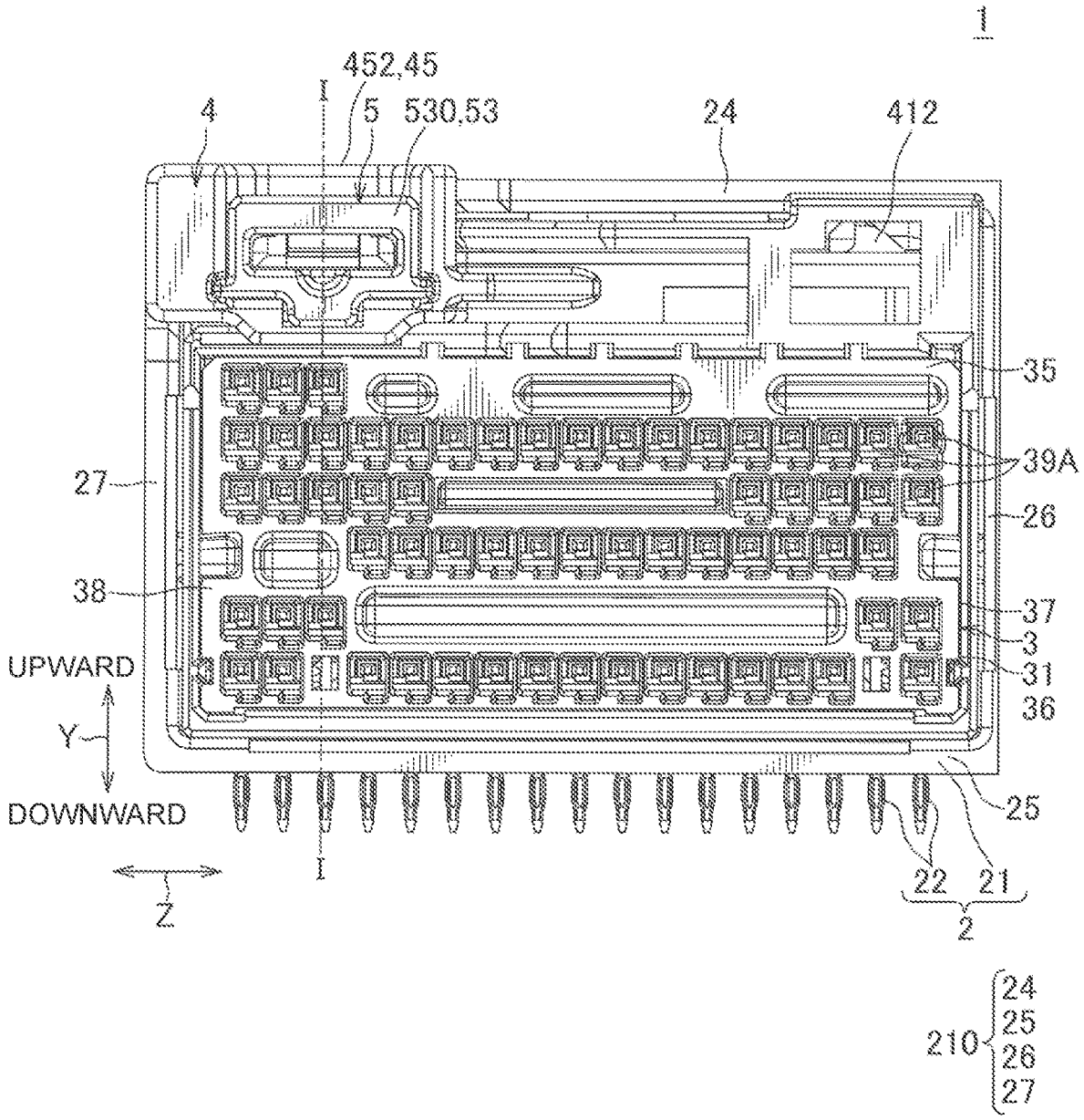
FIG. 3 is a front view of the connector unit.

Hereinafter, embodiments of the present invention will be described with reference to FIGS. 1 to 10. FIG. 1 is a perspective view illustrating a state of a connector unit 1 according to an embodiment of the present invention before mating the male connector 2 and the female connector 3 with each other. FIG. 2 is a perspective view illustrating a state of the connector unit 1 in which the male connector 2 and the female connector 3 are mated with each other. FIG. 3 is a front view of the connector unit 1. In FIGS. 1 and 2, male terminals 22 are omitted which are part of the male connector 2 (described below).

Figure 4:
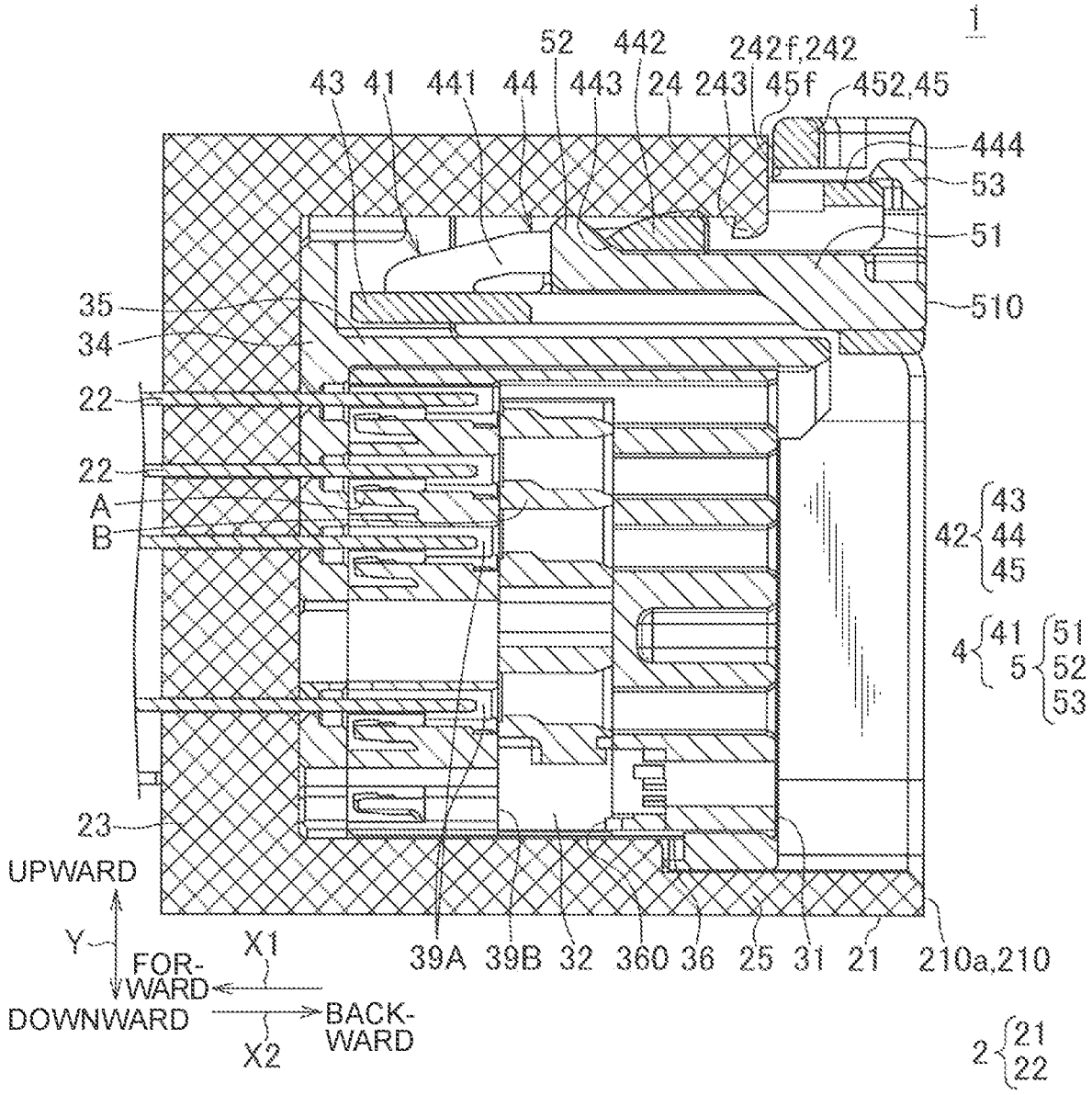
FIG. 4 is a sectional view along the line I-I in FIG. 3.

As shown in FIGS. 1 and 2, the connector unit 1 according to the present embodiment includes the male connector 2, the female connector 3, and a lever element 4 which is configured to be rotated in order to bring the female connector 3 close to the male connector 2 and mate them with each other. According to the present embodiment, a mating direction of the male connector 2 and the female connector 3 shall be an X-direction, while two directions substantially orthogonal to the X-direction shall be a Y- and Z-direction. A rotation axis direction of the lever element 4 shall extend along the Y-direction. An X1-direction and X2-direction (a direction for bringing the male connector 2 close to the female connector 3) may be referred to as "forward direction" and "backward direction" respectively. Further, one direction along this Y-direction may referred to as "upward", while the other opposite direction along the Y-direction may be referred to as "downward". FIGS. 2 to 4 shows a mating ensuring state in which the male connector 2 and the female connector 3 are ensured to be mated with each other. As used in the present embodiment, the term "mating ensuring state" refers to a state in which the lever element 4 has been rotated and a lever locked portion 442 of the lever element 4 (locked portion) is locked to a locking protrusion 243 of the male connector 2 (locking portion) and the sliding element 5 has slid from a waiting position (protruding position) to a detecting position (pushed-in position).

As shown in FIGS. 3 and 4, the male connector 2 includes a male housing 21 (second housing) and male terminals 22.

The male housing 21 is formed in a quadrilateral tube shape with an extending direction (axial direction of the tube) along the X-direction, e.g. from a resin element. As shown in FIGS. 3 and 4, the male housing 21 includes a male wall portion 23 (see FIG. 4) extending along the ZY-plane as well as four male surrounding walls 24, 25, 26 and 27, wherein the male surrounding walls 24, 25, 26 and 27 are continuous with the male wall portion 23. The four male surrounding walls 24, 25, 26 and 27 form a hood portion 210 for accommodating the female connector 3 and the lever element 4.

Figure 5:
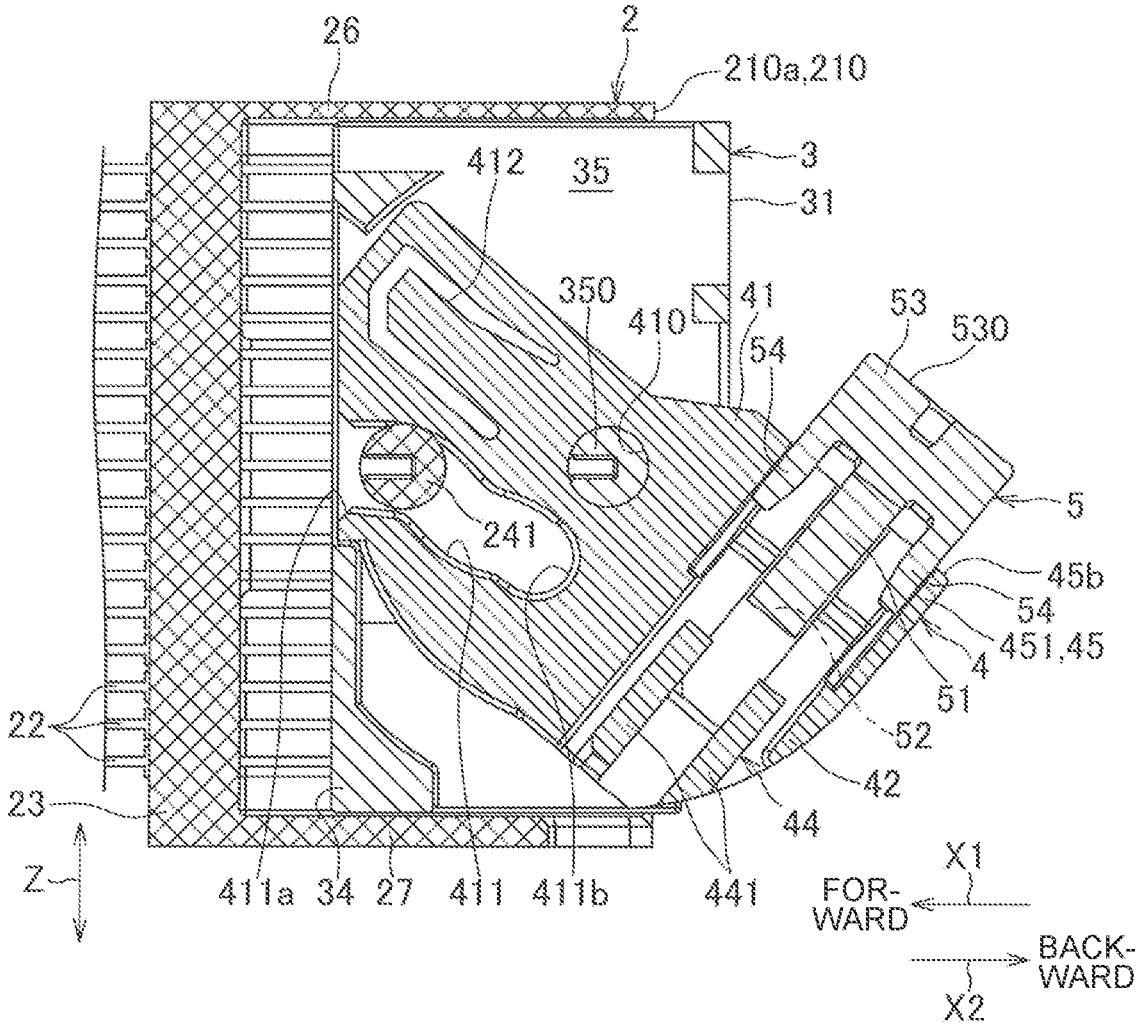
FIG. 5 is a transverse sectional view illustrating how the male connector and the female connector are mated with each other.
Figure 6A:
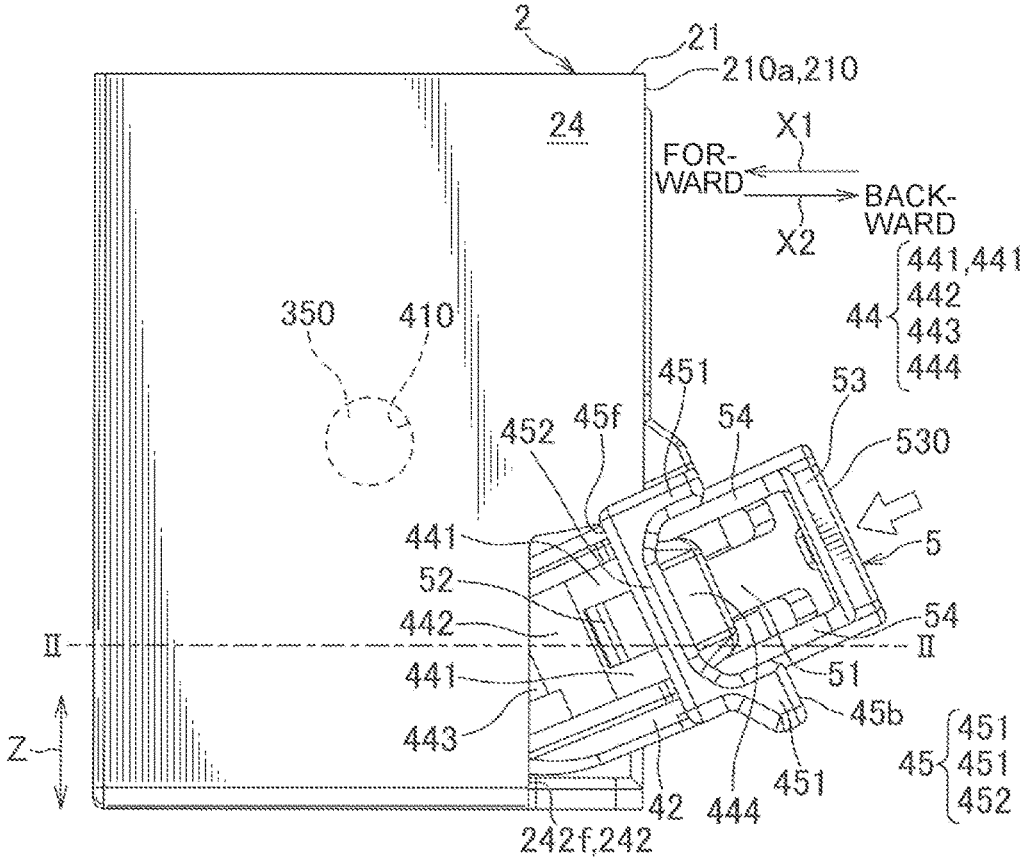
FIG. 6A is a plan view for explaining an assembly procedure of the connector unit, illustrating that a lever main body as a part of the connector unit is positioned in an initial position.

As shown in FIGS. 4 and 5, a male upper wall 24 of the four male surrounding walls 24, 25, 26 and 27 which extends along the ZX-plane includes a guide protrusion 241 (see FIG. 5), an indentation 242, and a locking protrusion 243 as a locking portion according to claims. The guide protrusion 241 protrudes downward from the male upper wall 24. The guide protrusion 241 is configured to be inserted into and guided by a guide groove 411 in the lever element 4 as described below. The indentation 242 is formed by cutting off a corner in a rectangular shape at one end of the male upper wall 24 when seen in the X2-direction and in the Z-direction. As shown in FIG. 6A, the indentation 242 exposes a decoupling operating portion 444 of the lever element 4 as described below. The locking protrusion 243 is formed at a front end of the indentation 242 (an end thereof in the X1-direction) so as to protrude downward, as shown in FIGS. 1 and 4.

The male terminals 22 are formed in a L-shape as shown in FIGS. 3 and 4, wherein they are configured to be connected on their one end side to a board (not shown) and extend on the other opposite end side through the male wall portion 23 of the male housing 21 to be electrically connected to female terminals (not shown) as described below.

The female connector 3 includes the female housing 31 (first housing), a side spacer 32, and female terminals, as shown in FIG. 4.

As shown in FIG. 4, the female housing 31 includes a female wall portion 34 extending along the ZY-plane, four female surrounding walls 35, 36, 37 and 38 (see FIG. 3), a plurality of terminal accommodating chambers 39A, and a spacer accommodating chamber 39B, wherein the female surrounding walls 35, 36, 37 and 38 are continuous with the female wall portion 34. As shown in FIGS. 1 and 5, a female upper wall 35 of the four female surrounding walls 35, 36, 37 and 38 which extends along the ZX-plane includes a lever rotating shaft 350 (see FIG. 5) and a temporary lock receiving portion 351 (see FIG. 1). Further, a female lower wall 36 of the four female surrounding walls 35, 36, 37 and 38 which is opposed to the female upper wall 35 includes an opening 360 formed therein, wherein the opening 360 is configured to insert the side spacer 32 therein, as shown in FIG. 4.

As shown in FIG. 5, the lever rotating shaft 350 protrudes upward from the female upper wall 35 and pivotably supports a lever main body 41 of the lever element 4 by being inserted into a shaft bearing portion 410 of the lever element 4, wherein the lever main body 41 and the shaft bearing portion 410 will be described below. The temporary lock receiving portion 351 is configured to be capable of locking (coming into contact with) a temporary lock arm 412 of the lever element 4 as described below. The temporary lock receiving portion 351 and the temporary lock arm 412 are locked to each other with the lever rotating shaft 350 pivotably supporting the lever main body 41. In the following description, a state in which the temporary lock arm 412 is locked by the temporary lock receiving portion 351 may be referred to as "initial position of the lever main body 41". In the initial position of the lever main body 41, an inlet 411*a* of the guide groove 411 in the lever element 4 is open forward, as shown in FIG. 5. When rotating the lever main body 41 from the initial position in the state where the temporary lock arm 412 is locked by the temporary lock receiving portion 351, the temporary lock arm 412 is unlocked from the temporary lock receiving portion 351.

The plurality of terminal accommodating chambers 39A are arranged in an up-down direction (Y-direction) and in the Z-direction, as shown in FIG. 4. Each of the terminal accommodating chambers 39A is formed in a quadrilateral tube shape with an extending direction (axial direction of the tube) along the X-direction, and accommodates a corresponding female terminal.

The spacer accommodating chamber 39B is a part of the terminal accommodating chamber 39A and accommodates the side spacer 32, as shown in FIG. 4. The side spacer 32 is accommodated into the spacer accommodating chamber 39B by being inserted into the opening 360 in the female housing 31, wherein it is configured so that the female terminals are inserted into the respective terminal accommodating chambers 39A in a temporary locking position of the side spacer 32, each of the female terminals is engaged with a lance A to primarily hold it, and each of the female terminals is engaged with an engaging portion B of the side spacer 32 by moving the side spacer 32 from the temporary locking position to a regular locking position in order to secondarily hold the female terminals.

When accommodated into the corresponding terminal accommodating chamber 39A, each of the female terminals is connected at one end to an electric wire (not shown) and electrically connected at the other end to a male terminal 22.

The lever element 4 includes the plate-shaped lever main body 41 and the sliding element 5 which is supported by the lever main body 41 so as to be slidable between the waiting position (see FIGS. 1 and 5) and the detecting position (see FIG. 2) as shown in FIGS. 1, 2 and 5, wherein the waiting position and the detecting position correspond to a protruding position and a pushed-in position according to claims, respectively. The lever main body 41 is formed e.g. with resin. The lever main body 41 is formed extending along the ZX-plane (i.e. in the same direction as the male upper wall 24 of the male housing 21 and the female upper wall 35 of the female housing 31).

As shown in FIG. 5, the lever main body 41 includes the shaft bearing portion 410, the guide groove 411, the temporary lock arm 412 to be locked to the temporary lock receiving portion 351 of the female housing 31, and a sliding element holding portion 42. The shaft bearing portion 410 is formed in a through-hole shape, wherein the lever rotating shaft 350 of the female housing 31 is inserted into the shaft receiving portion 410. In this manner, the lever element 4 is supported so as to be rotatable around the shaft bearing portion 410 and the lever rotating shaft 350 relative to the female housing 31. Such a lever main body 41 is configured to be rotated from the initial position to a completely rotated position, wherein in the completely rotated position, the male connector 2 and the female connector 3 are brought into a mated state. Here, it is not necessary that the shaft bearing portion 410 has a through-hole shape, but an inner surface of the lever main body 41 may be formed in a concave shape. Further, a shaft portion of the lever main body 41 may be formed in a convex shape, wherein the lever rotating shaft 350 of the female housing 31 may be formed in a through-hole shape or in a concave shape.

The guide groove 411 is formed in a slit shape having a concave cross section in the lever main body 41, wherein the guide protrusion 241 of the male housing 21 is inserted into the guide groove 411. The guide groove 411 is formed from a cam groove having a shape (trajectory) which brings the guide protrusion 241 close to the shaft bearing portion 410 when the lever main body 41 is rotated.

Here, by rotating the lever main body 41 and moving the guide protrusion 241 within the guide groove 411, the guide protrusion 241 is displaced between a "partially mated state" and the "mated state (which may be referred to as "completely mated state"), wherein the partially mated state is located between the inlet 411*a* of the guide groove 411 and a position before an end 411*b* of the guide groove 411 which is located deeper inside, wherein in the mated state, the guide protrusion 241 has reached the deeper end 411*b* of the guide groove 411. In the completely mated state, the lever main body 41 together with the female housing 31 is mated with the male housing 21, and the male housing 21 has come close to the female housing 31, so that the male terminals 22 are electrically connected to the respective female terminals.

Figure 6B:
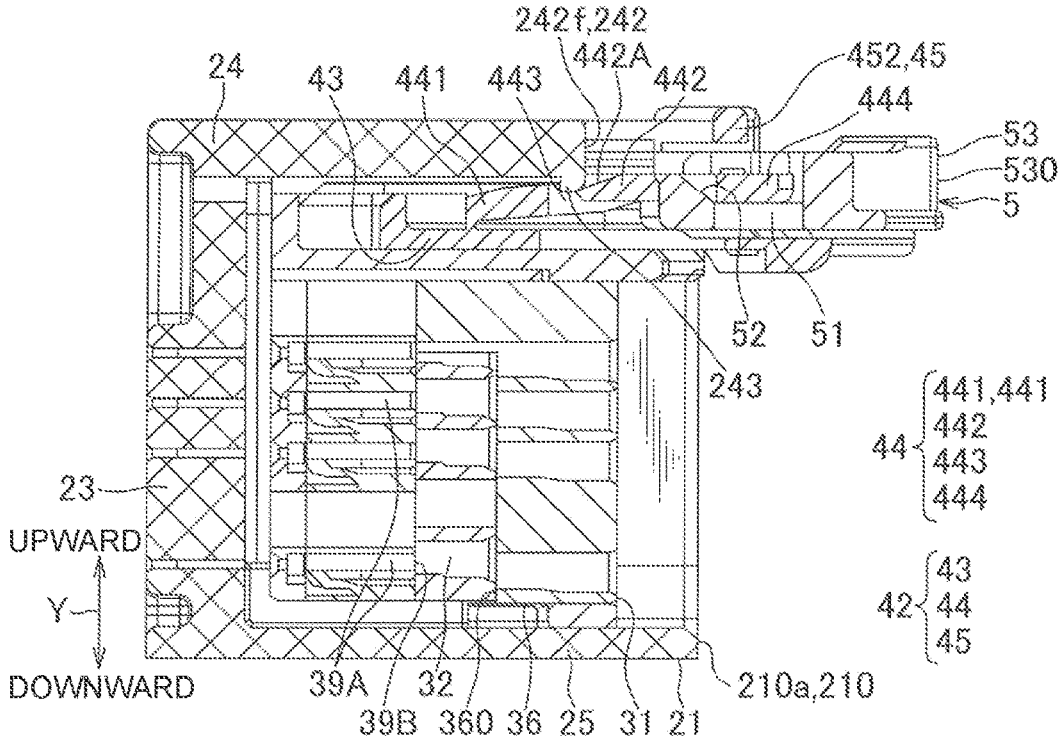
FIG. 6B is a sectional view along the line II-II in FIG. 6A.

As shown in FIGS. 6A and 6B, the sliding element holding portion 42 includes a plate-shaped portion 43 (see FIG. 6B), a lever arm portion 44 and a cover portion 45, wherein the plate-shaped portion 43 is located opposed to the male upper wall 24 of the male housing 21, and the cover portion 45 covers a free end side of the lever arm portion 44.

The lever arm portion 44 includes a pair of lever arms 441, 441, the lever locked portion 442, an entry receiving portion 443 and the decoupling operating portion 444 as shown in FIG. 6A, wherein the lever locked portion 442 is configured to be locked to the locking protrusion 243 of the male housing 21 and corresponds to a locked portion according to claims, wherein the entry receiving portion 443 corresponds to a portion to be entered according to claims.

As shown in FIGS. 4 and 5, the pair of lever arms 441, 441 is spaced in the Z-direction in a state of the guide protrusion 241 which is positioned at the deeper end 411*b* of the guide groove 411 in the lever main body 41 (the completely mated state) (see FIGS. 8A, 8B, 9A and 9B), wherein the pair of lever arms 441, 441 is additionally formed in the X2-direction so that their front ends are continuous with the plate-shaped portion 43 and their back ends form free ends.

The lever locked portion 442 is provided between the pair of lever arms 441, 441 so as to be coupled to the pair of lever arms 441, 441, as shown in FIGS. 4, 6A and 6B. The lever locked portion 442 is provided in a middle region in an extending direction of the pair of lever arms 441, 441. The lever locked portion 442 has a sliding surface 442A formed thereon, wherein the sliding surface 442A allows the locking protrusion 243 to slide thereon. The sliding surface 442A is formed from a slope surface which is inclined downward in the forward direction (X1-direction), as shown in FIG. 6B.

The entry receiving portion 443 is provided between the pair of lever arms 441, 441 adjacent to a forward side of the lever locked portion 442 (a side thereof facing in the X1-direction), as shown in FIGS. 6A and 6B. This entry receiving portion 443 is formed from a space which allows a slide protruding portion 52 of the sliding element 5 to enter the space from downward.

The decoupling operating portion 444 is provided at the back ends of the pair of lever arms 441, 441 (their ends facing in the X2-direction), as shown in FIGS. 6A and 6B. This decoupling operating portion 444 is provided in a plate shape orthogonal to the up-down direction (Y-direction), wherein the decoupling operating portion 444 is configured to be capable of displace the pair of lever arms 441, 441 downward by pushing the decoupling operating portion 444 downward. In a natural state of the pair of lever arms 441, 441, the decoupling operating portion 444 is positioned above the lever locked portion 442 (see FIG. 4). The decoupling operating portion 444 is provided so as to be displaceable downward in the completely mated state. Furthermore, the decoupling operating portion 444 is visible to operators through the indentation 242 in the male housing 21.

The cover portion 45 is standing from the plate-shaped portion 43 as shown in FIG. 6A, and includes a pair of opposing walls 451, 451 and a cover wall 452, wherein the pair of opposing walls 451, 451 are opposing to both sides of the pair of lever arms 441, 441 in the Z-direction, and the cover wall 452 connects upper ends of the pair of opposing walls 451, 451. In the completely mated state, this cover wall 452 is positioned above the decoupling operating portion 444, wherein a front end 45*f* of the cover wall 452 is opposed to a front end edge 242*f* of the indentation 242 in the male housing 21. Furthermore, a back end of the cover wall 452 is cut off at a portion including the middle portion. This renders the decoupling operating portion 444 pressable.

Figure 9A:
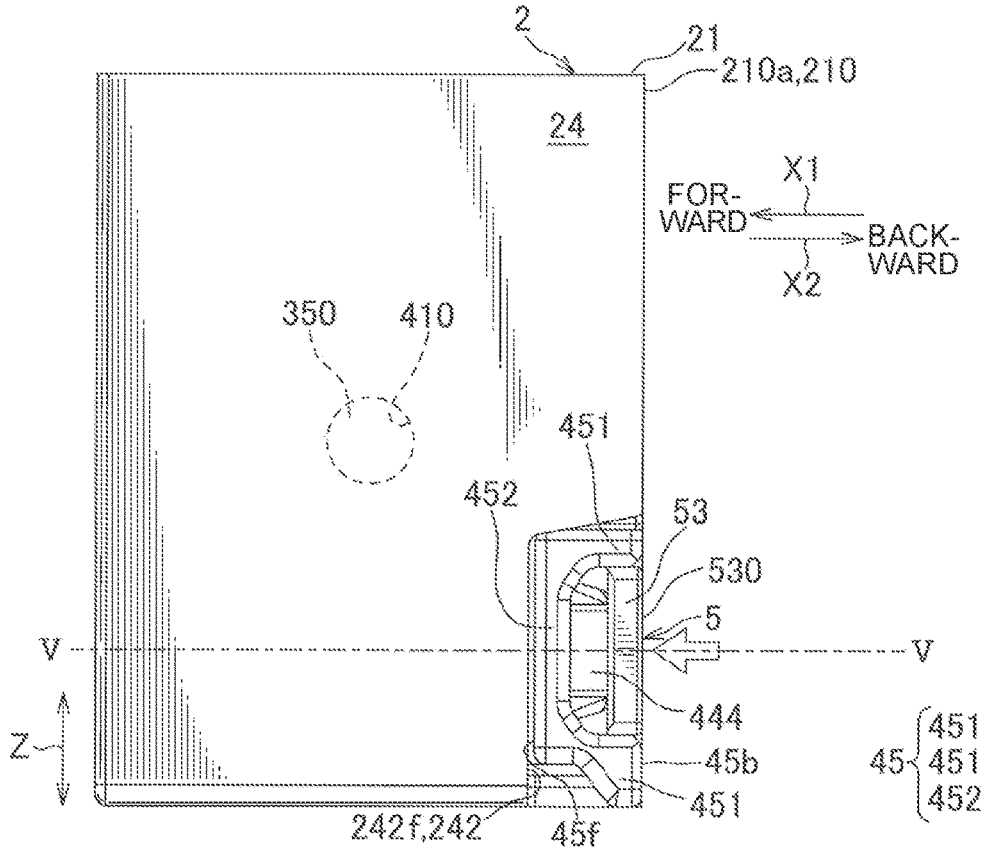
FIG. 9A is a plan view illustrating that the sliding element is positioned in a pushed-in position.
Figure 9B:
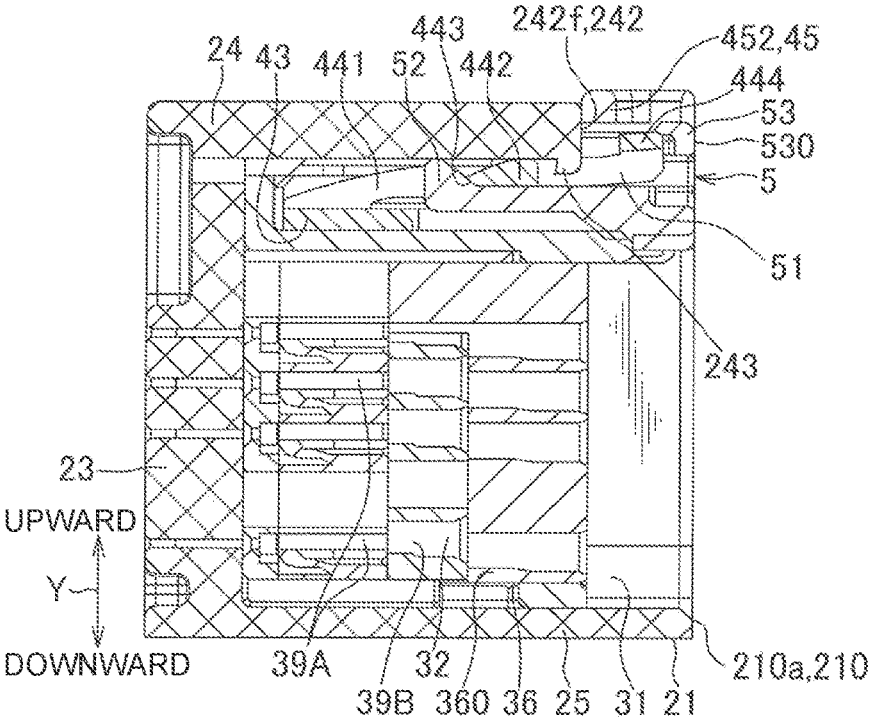
FIG. 9B is a sectional view along the line V-V in FIG. 9A.

The sliding element 5 includes a slide arm 51, the slide protruding portion 52 as a limiting portion according to claims, a pressing wall portion 53, and a pair of lock arms 54, 54, as shown in FIGS. 3, 4 and 5. In the completely mated state, the slide arm 51 extends in the X1-direction and is configured to be bendable in the Y-direction, as shown in FIGS. 9A and 9B. The slide protruding portion 52 protrudes upward from a front end (free end) of the slide arm 51.

The pressing wall portion 53 protrudes upward from a back end (base end) of the slide arm 51 and is provided in a C-shape, as shown in FIGS. 1, 3, 4 and 5. When the sliding element 5 is in the detecting position, the pressing wall portion 53 is positioned between the pair of opposing walls 451, 451 of the cover portion 45 of the lever main body 41, wherein when the sliding element 5 is in the waiting position, the pressing wall portion 53 protrudes backward from back end surfaces 45*b* of the pair of opposing walls 451, 451 of the cover portion 45 (end edge of the lever main body 41). This means that when the sliding element 5 is in the waiting position, the pressing wall portion 53 protrudes from the back end surfaces 45*b* of the cover portion 45 which represent the end edge of the lever main body 41 according to claims. The pressing wall portion 53 is provided so that in the detecting position of the sliding element 5, a surface 530 of the pressing wall portion 53 which is facing backward (pushing surface 530) is positioned in the same plane as an opening edge 210*a* of the hood portion 210 (see FIGS. 2 and 9A).

The pair of lock arms 54, 54 is provided on both sides of the slide arm 51 in the Z-direction, and configured to be bendable in the Z-direction. Each of the lock arms 54, 54 is formed in the X1-direction so that a back end (base end) of the lock arm 54, 54 is continuous with the pressing wall portion 53 and a front end of the lock arm 54, 54 forms a free end. Each of the lock arms 54 includes a lock protrusion (not shown) at its free end, the lock protrusion configured to be locked to a front end surface 45*f* side of the cover portion 45.

For attaching such a sliding element 5 to the sliding element holding portion 42, the pair of lock arms 54, 54 is inserted between the pair of opposing walls 451, 451 of the cover portion 45 from backward. In this manner, the lock protrusions are locked to the front end surface 45*f* side of the cover portion 45 as shown in FIG. 6A, wherein the slide protruding portion 52 of the slide arm 51 is brought into contact with the lever locked portion 442. In this manner, the sliding element 5 is attached to the sliding element holding portion 42. As shown in FIG. 6B, the sliding element 5 is positioned in the waiting position in which the slide protruding portion 52 is positioned behind the lever locked portion 442 and is in contact with the lever locked portion 442.

Next, a procedure for assembling the connector unit 1 will be described.

First, as shown in FIG. 1, the sliding element 5 previously attached to the sliding element holding portion 42 is positioned in the waiting position. Then, the lever main body 41 is brought close to the female upper wall 35 of the female housing 31, the shaft bearing portion 410 is pivotably supported on the lever rotating shaft 350, and the temporary lock arm 412 is locked to the temporary lock receiving portion 351. The lever main body 41 is positioned in the initial position. In this manner, the lever main body 41 is rotatably supported by the female housing 31.

Next, referring to FIG. 4, the side spacer 32 is inserted into the opening 360 of the female housing 31. When the side spacer 32 is positioned in the temporary locking position, the female terminals are inserted into the respective terminal accommodating chambers 39A, and each of the female terminals is engaged with the lance A to primarily hold the female terminals. Further, each of the female terminals is engaged with the engaging portion B of the side spacer 32 by moving the side spacer 32 from the temporary locking position to the regular locking position in order to secondarily hold the female terminals. In this manner, the female terminals are supported within the respective terminal accommodating chambers 39A.

Next, the female housing 31 is brought close to the hood portion 210 of the male housing 21 in the X2-direction to insert the female housing 31 into the hood portion 210, as shown in FIG. 1. In this manner, the guide protrusion 241 of the female housing 31 is inserted into the guide groove 411 in the lever main body 41 as shown in FIG. 5, wherein the guide protrusion 241 is positioned in the vicinity of the inlet 411*a* of the guide groove 411. At this time, the sliding element 5 is positioned in the waiting position as shown in FIG. 6B, wherein the slide protruding portion 52 is in contact with the lever locked portion 442. Furthermore, the guide protrusion 241 is in the partially mated state in the vicinity of the inlet 411*a* of the guide groove 411.

Figure 7A:
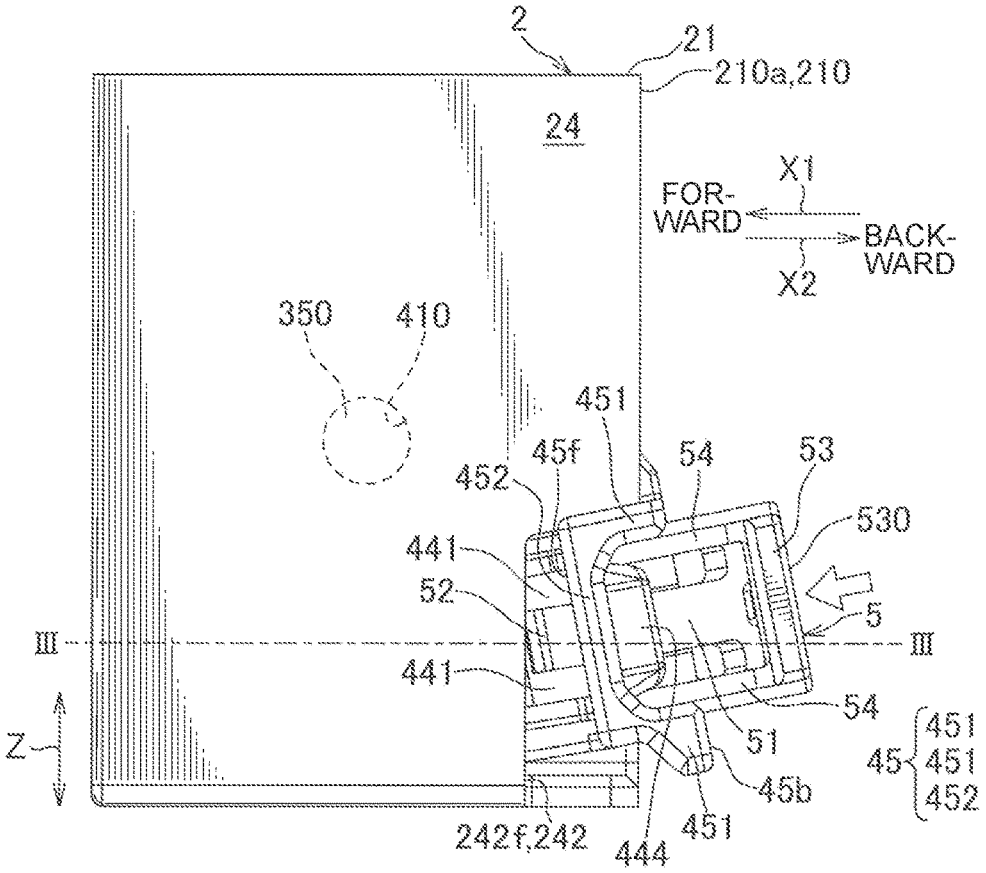
FIG. 7A is a plan view illustrating a post-process after FIG. 6A, showing that the lever main body has been further rotated from the initial position.
Figure 7B:
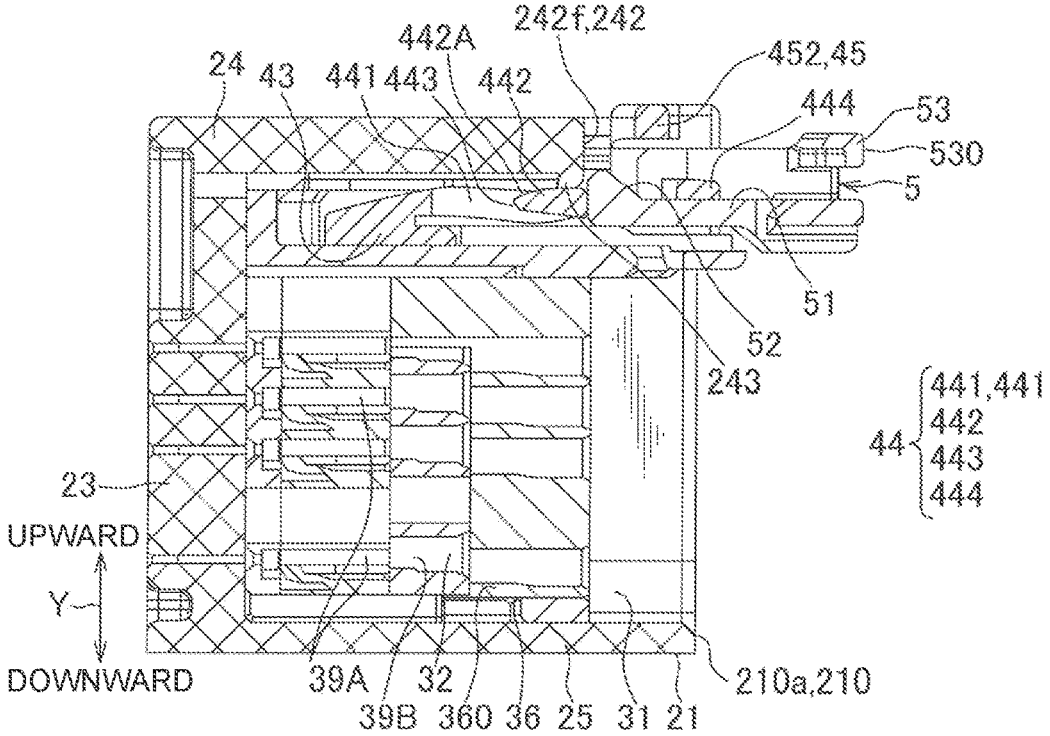
FIG. 7B is a sectional view along the line III-III in FIG. 7A.
Figure 8A:
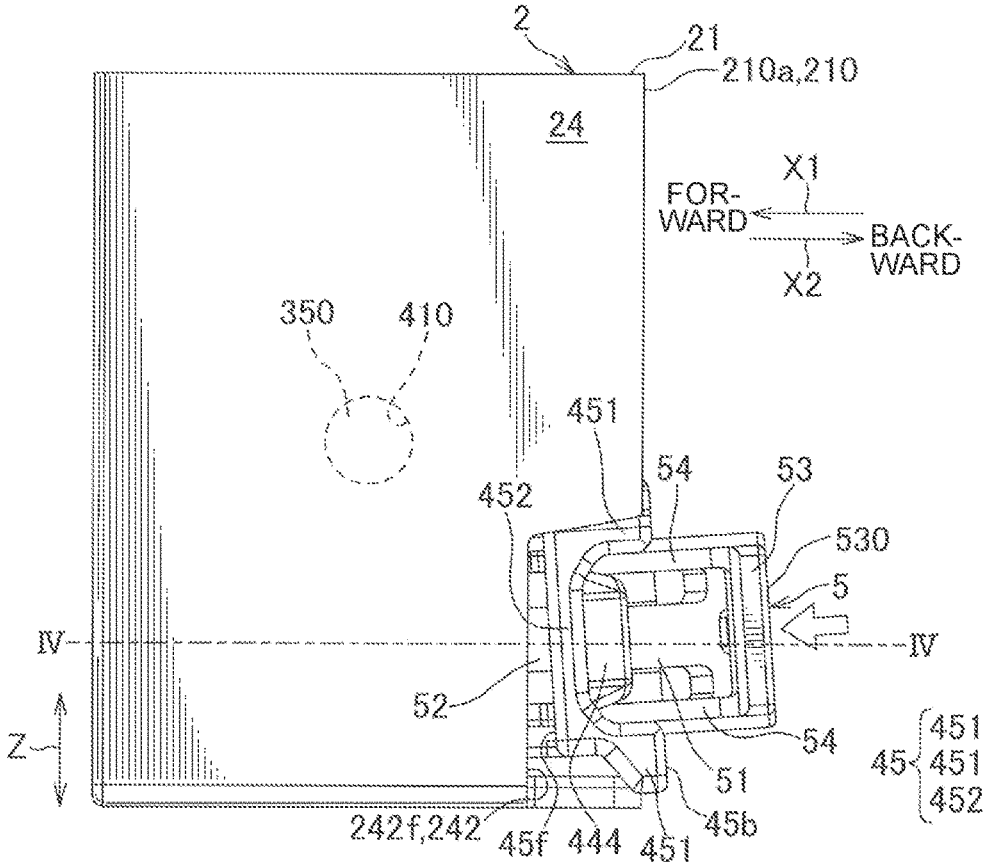
FIG. 8A is a plan view illustrating a post-process after FIG. 7A, showing how a locked portion is locked by a locking portion.
Figure 8B:
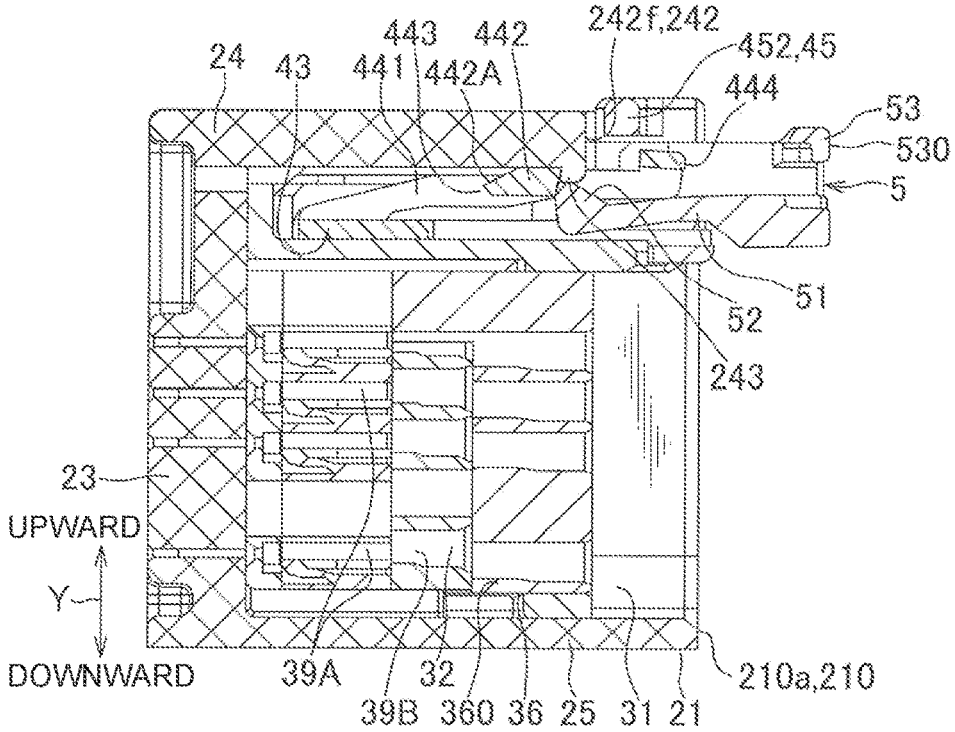
FIG. 8B is a sectional view along the line IV-IV in FIG. 8A.

Next, the pushing surface 530 of the sliding element 5 in the waiting position is pushed to rotate the lever main body 41, as shown in FIGS. 6A and 6B. With further pushing the pushing surface 530, the lever locked portion 442 is pushed by the slide protruding portion 52, and the locking protrusion 243 slides on the sliding surface 442A of the lever locked portion 442 so that the lever arms 441 are bent downward, whereby the lever locked portion 442 is pressed down under the locking protrusion 243, as shown in FIGS. 7A and 7B. As the pushing surface 530 is further pushed, the lever locked portion 442 crosses over the locking protrusion 243, as shown in FIGS. 8A and 8B. Once the lever locked portion 442 has crossed over the locking protrusion 243, the lever arms 441 are elastically returned to their original shape. Due to the lever locked portion 442 being positioned on the forward side of the locking protrusion 243, the lever locked portion 442 is locked to the locking protrusion 243. Then, the lever main body 41 is in the completely mated state (mated state) where the guide protrusion 241 is positioned at the deeper end 411*b* of the guide groove 411.

On the other hand, with further pushing the pushing surface 530 while the slide protruding portion 52 remains in contact with the lever locked portion 442, as shown in FIGS. 7A and 7B, the slide arm 51 is bent downward as shown in FIGS. 8A and 8B, wherein the slide protruding portion 52 is pressed down under the locking protrusion 243 and the lever locked portion 442. With further pushing, the slide protruding portion 52 crosses over the locking protrusion 243 and the lever locked portion 442. This cancels the contact state between the slide protruding portion 52 and the lever locked portion 442, which allows the sliding element 5 to be moved from the waiting position to the detecting position.

As the sliding element 5 is further pushed and slides from the waiting position toward the detecting position, the slide protruding portion 52 enters the entry receiving portion 443 as shown in FIGS. 9A and 9B, wherein the slide arm 51 is elastically returned to its original shape. The backward movement of the lever locked portion 442 (movement in an unlocking direction) is limited due to the slide protruding portion 52 which is positioned in the front of the lever locked portion 442 while the sliding element 5 is in the detecting position, as shown in FIGS. 9A and 9B.

In this manner, based on the fact that the sliding element 5 is allowed to slide from the waiting position to the detecting position, an operator can detect (recognize) that the completely mated state is established. Consequently, this ensures that the male connector 2 and the female connector 3 is mated with each other.

Further, in the detecting position of the sliding element 5, the pushing surface 530 of the sliding element 5 is positioned in the same plane as the opening edge 210*a* of the hood portion 210 of the male connector 2. This enables the operator to easily check additionally with his/her eyes that the connector unit 1 is in the completely mated state (mated state). This means that the mated state between the male connector 2 and the female connector 3 is ensured by sliding the sliding element 5 from the waiting position to the detecting position and by visual check (the mating ensuring state is established). In this manner, the connector unit 1 is assembled.

In the following description, a procedure for unlocking the lever locked portion 442 from the locking protrusion 243 will be described with reference to FIGS. 8A and 8B.

First, the sliding element 5 is moved from the detecting position to the waiting position which located backward (in the X2-direction), in order to return the sliding element 5 according to FIGS. 8A and 8B to the waiting position. In this state, the decoupling operating portion 444 is pushed down. This causes the lever arms 441 to be bent downward, wherein the lever locked portion 442 is pushed down at this time. In this state, the decoupling operating portion 444 is moved backward which causes the lever locked portion 442 to cross over the locking protrusion 243. In this manner, the lever locked portion 442 and the locking protrusion 243 are unlocked from each other. As a result, it is possible to decouple the male connector 2 and the female connector 3 from each other by rotating the lever element 4 and thus displacing it from the completely rotated position to the initial position.

According to the embodiment as described above, the lever main body 41 is rotated by pushing the sliding element 5 so that the completely mated state (mated state) is established between the male connector 2 and the female connector 3, wherein the sliding element 5 is additionally allowed to be moved from the waiting position (protruding position) to the detecting position (pushed-in position), which enables the operator to detect (recognize) that the male connector 2 and the female connector 3 are in the completely mated state. With the one single operation (action) as described above, i.e. pushing the sliding element 5, the male connector 2 and the female connector 3 can be mated with each other, wherein at the same time, the operator can detect (recognize) that the male connector 2 and the female connector 3 are in the completely mated state, which may enable the operability for assembling the connector unit 1 to be improved.

Further, in the detecting position (pushed-in position) of the sliding element 5, the pushing surface 530 of the sliding element 5 is positioned in the same plane as the opening edge 210*a* of the hood portion 210. This enables that, based on the fact that the pushing surface 530 of the sliding element 5 is positioned in the same plane as the opening edge 210*a* of the hood portion 210, the operator can easily check additionally with his/her eyes that the male connector 2 and the female connector 3 are in the completely mated state.

Figure 10:
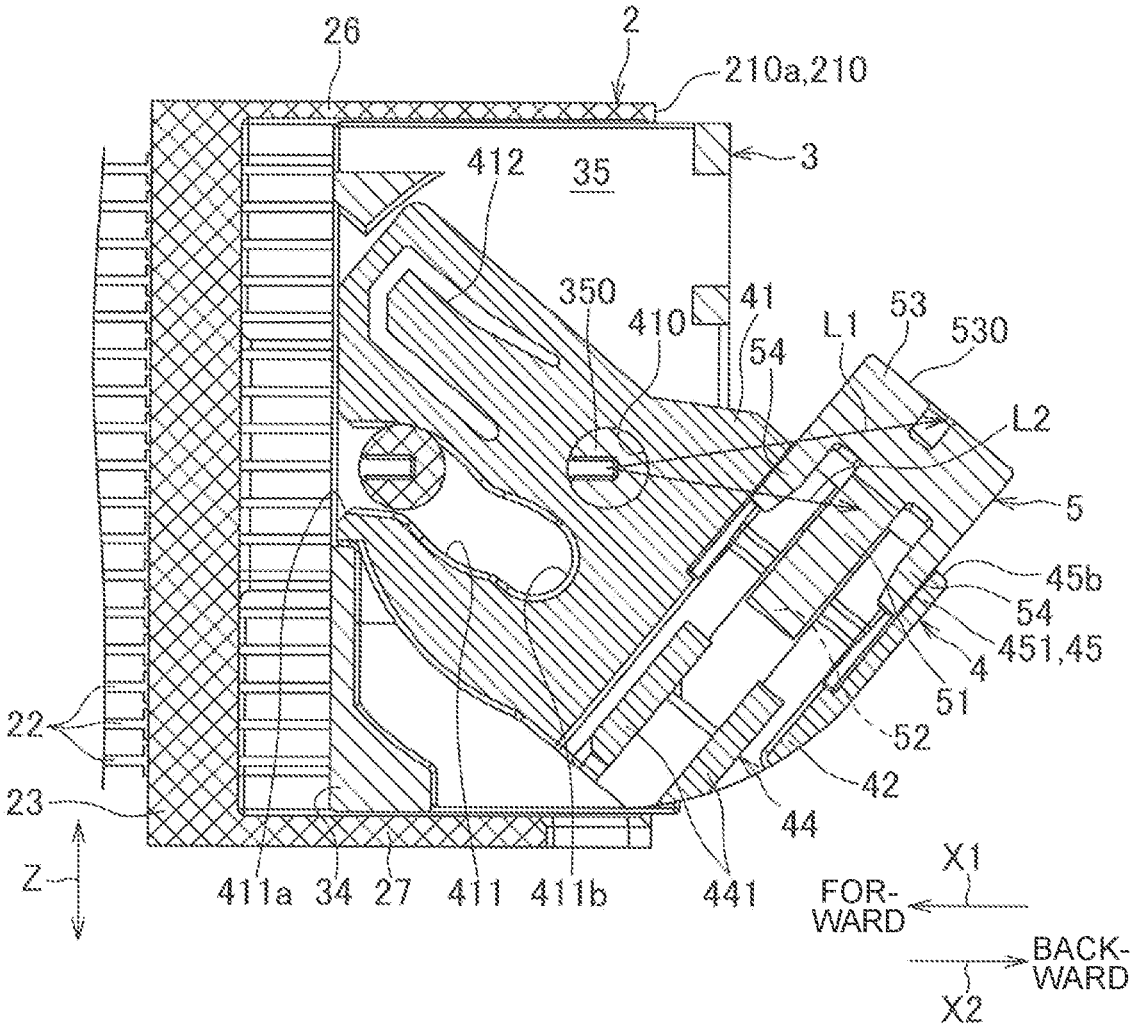
FIG. 10 is a view for explaining effects of the present embodiment.

Furthermore, the sliding element 5 is configured so that when the sliding element 5 is positioned in the waiting position (protruding position), a first distance L1 of the shaft bearing portion 410 (pivotably supporting position) of the lever main body 41 to the pushing surface 530 is larger than a second distance L2 of the shaft bearing portion 410 to the back end surface 45*b* of the cover portion 45 (end edge of the lever main body), as shown in FIG. 10. This enables that in the waiting position (protruding position) of the sliding element 5, the distance of the shaft bearing portion 410 (fulcrum) to the pushing surface 530 (point of action) is extended by an extent corresponding to protrusion of the pushing surface 530 from the back end surface 45*b* of the cover portion 45, which allows the lever main body 41 to be rotated with a smaller force.

Although the best configuration, method etc. for implementing the present invention are disclosed in the above description, the present invention is not limited thereto. Namely, while the present invention is particularly shown and described mainly with regard to the specific embodiments, the above mentioned embodiments may be modified in various manners in shape, material characteristics, amount or other detailed features by those skilled in the art without departing from the scope of the technical idea and purpose of the present invention. Therefore, the description with limited shapes, material characteristics etc. according to the above disclosure is not limiting the present invention, but merely illustrative for easier understanding the present invention so that the description using names of the elements without a part or all of the limitations to their shapes, material characteristics etc. is also included in the present invention.

REFERENCE SIGNS LIST

1 Connector unit
21 Male housing (second housing)
210 Hood portion
210*a* Opening edge of the hood portion
243 Locking protrusion (locking portion)
31 Female housing (first housing)
4 Lever element
41 Lever main body
45*b* Back end surface of a cover portion (end edge of the lever main body)
410 Shaft bearing portion (pivotably supporting position)
442 Lever locked portion (locked portion)
5 Sliding element
530 Pushing surface
L1 First distance
L2 Second distance

What is claimed is:

1. A connector unit comprising:

a first housing and a second housing which are mateable with each other; and a lever element to be pivotably supported by the first housing, wherein the lever element includes a plate-shaped lever main body to be pivotably supported by the first housing, and a sliding element which is provided at the lever main body in a slidable manner, wherein the lever main body is provided so as to be rotatable between an initial position and a completely rotated position, wherein in the completely rotated position, the first housing and the second housing are in a completely mated state, wherein the second housing is provided with a locking portion for locking the lever main body, wherein the lever main body is provided with a locked portion which is configured to be locked by the locking portion in the completely rotated position, wherein the sliding element is provided so as to be slidable between a protruding position and a pushed-in position, wherein the sliding element protrudes from the lever main body in the protruding position, and is pushed deeper into the lever main body in the pushed-in position than in the protruding position, and wherein the sliding element is configured so that in the protruding position, sliding the sliding element causes the lever main body to be rotated and the locking portion to lock the locked portion and then the sliding element slides from the protruding position to the pushed-in position.

2. The connector unit according to claim 1, wherein the second housing includes a hood portion for accommodating the first housing, and wherein the sliding element has a pushing surface which is oriented in a direction opposite to a push-in direction of the sliding element into the lever main body, wherein the pushing surface is positioned in a same plane as an opening edge of the hood portion when the sliding element is positioned in the pushed-in position.

3. The connector unit according to claim 2, wherein when the sliding element is positioned in the protruding position, a pushing surface of the sliding element which is oriented in a direction opposite to a push-in direction of the sliding element into the lever main body protrudes from an end edge of the lever main body, and wherein when the sliding element is positioned in the protruding position, a first distance of a pivotably supporting position of the lever main body to the pushing surface is larger than a second distance of the pivotably supporting position to the end edge of the lever main body.

4. The connector unit according to claim 1, wherein when the sliding element is positioned in the protruding position, a pushing surface of the sliding element which is oriented in a direction opposite to a push-in direction of the sliding element into the lever main body protrudes from an end edge of the lever main body, and wherein when the sliding element is positioned in the protruding position, a first distance of a pivotably supporting position of the lever main body to the pushing surface is larger than a second distance of the pivotably supporting position to the end edge of the lever main body.

* * * * *